US012084875B2

(12) United States Patent
Wang

(10) Patent No.: US 12,084,875 B2
(45) **Date of Patent: *Sep. 10, 2024**

(54) INTERLOCKING DEVICE FOR MODULAR BUILDING FORMWORKS

(71) Applicant: Chien-Ho Wang, Taichung (TW)

(72) Inventor: Chien-Ho Wang, Taichung (TW)

( * ) Notice: Subject to any disclaimer, the term of this patent is extended or adjusted under 35 U.S.C. 154(b) by 70 days.

This patent is subject to a terminal disclaimer.

(21) Appl. No.: 17/826,450

(22) Filed: May 27, 2022

(65) Prior Publication Data

US 2023/0092689 A1 Mar. 23, 2023

(30) Foreign Application Priority Data

Sep. 22, 2021 (TW) ..... 110135167

(51) Int. Cl.
*E04G 17/04* (2006.01)

(52) U.S. Cl.
CPC ..... *E04G 17/042* (2013.01)

(58) Field of Classification Search
CPC ..... E04G 17/065; E04G 9/08; E04G 17/02; E04G 17/04; E04G 17/042; E04G 2017/008; E05C 3/36; E05C 5/04; E04B 2/8635; E04B 2002/867
USPC ..... 249/44, 47, 192, 196; 292/301, 337, 22
See application file for complete search history.

(56) References Cited

U.S. PATENT DOCUMENTS 1,364,736 A * 1/1921 Domanski ..... E05C 5/04 70/393
1,382,758 A * 6/1921 Brown ..... E05C 5/04 292/251
1,410,829 A * 3/1922 Morgenthau ..... E05C 5/04 70/149
1,424,136 A * 7/1922 Morgenthau ..... E05C 5/04 70/149
2,297,899 A * 10/1942 Krueger ..... E04G 17/045 182/129

(Continued)

FOREIGN PATENT DOCUMENTS

CN 112593701 A 4/2021
DE 202011052193 U1 * 4/2012 ..... E05B 65/0075

(Continued)

OTHER PUBLICATIONS

A Search Report, which was issued to European counterpart application No. 22177072.0 by the EPO on Nov. 29, 2022.

(Continued)

*Primary Examiner* — Beth A Stephan
(74) *Attorney, Agent, or Firm* — Burris Law, PLLC

(57) ABSTRACT

An interlocking device is adapted to lock two modular building formworks. Each formwork includes a wall plate and a frame. Each frame has aligning and locking holes. The interlocking device includes a housing unit secured to the frame, a rotation transferring unit having intersecting input and output shafts, a transmitting unit movably coupled with the output shaft, and a locking member having a head portion, a positioning portion and a threaded portion. The locking member is insertable into the aligning hole of one frame to have the head portion abutting against the frame, and the threaded portion is matingly engageable in the locking hole of the other frame so as to lock the two formworks.

9 Claims, 8 Drawing Sheets

(56) References Cited

U.S. PATENT DOCUMENTS

| | | | | | |
|---|---|---|---|---|---|
| 2,526,381 | A * | 10/1950 | Mathis | E04G 11/10 | 249/196 |
| 3,877,674 | A * | 4/1975 | Cerutti | E04G 17/042 | 249/190 |
| 5,104,070 | A * | 4/1992 | Johnson | E05C 5/04 | 244/172.4 |
| 5,288,051 | A * | 2/1994 | Ward | E04G 17/04 | 292/DIG. 58 |
| 5,686,010 | A * | 11/1997 | Lee | E04G 11/06 | 249/161 |
| 5,743,670 | A * | 4/1998 | Ader | E04B 1/6137 | 403/403 |
| 6,428,061 | B1 * | 8/2002 | Daoud | E05C 5/04 | 411/910 |
| 6,691,976 | B2 * | 2/2004 | Myers | E04G 17/047 | 249/191 |
| 8,864,100 | B2 * | 10/2014 | Ward | E04G 17/04 | 292/164 |

FOREIGN PATENT DOCUMENTS

| | | | | |
|---|---|---|---|---|
| EP | 1818479 | A1 * | 8/2007 | E04G 17/042 |
| JP | H11223164 | A | 8/1999 | |
| KR | 1020040041688 | A | 5/2004 | |
| KR | 1020170081836 | A | 7/2017 | |
| TW | I716319 | B | 1/2021 | |
| WO | WO-2012034860 | A1 * | 3/2012 | E05B 17/0025 |

OTHER PUBLICATIONS

Search Report appended to an Office Action, which was issued to Taiwanese counterpart application No. 110135167 by the TIPO on Jun. 21, 2022 with an English translation thereof.

* cited by examiner

INTERLOCKING DEVICE FOR MODULAR BUILDING FORMWORKS

CROSS-REFERENCE TO RELATED APPLICATION

This application claims priority of Taiwanese Patent Application No. 110135167, filed on Sep. 22, 2021.

FIELD

The disclosure relates to a modular building formwork apparatus, and more particularly to an interlocking device for locking modular building formworks.

BACKGROUND

A conventional modular building formwork assembly disclosed in TWI 716319 includes at least four formwork walls and at least one connecting hornbeam block. Each formwork wall has a mold surface at one side thereof, a mounting surface at the other side thereof, and two connecting posts disposed on upper and lower ends of the mounting surface. Each connecting post has a plurality of through holes, and the connecting hornbeam block has a plurality of connecting holes. The formwork walls are aligned with and abut against each other such that the connecting hornbeam block is disposed on both the connecting posts and a plurality of fasteners extend through the through holes and the connecting holes to cooperatively form the formwork assembly. However, by using the fasteners to secure the connecting hornbeam block to the formwork walls, misalignment of the formwork walls may occur and the mold surfaces of the formwork walls may become uneven.

SUMMARY

Therefore, an object of the disclosure is to provide an interlocking device for modular building formworks that can alleviate at least one of the drawbacks of the prior art.

According to the disclosure, the interlocking device is adapted to lock two modular building formworks. Each of the formworks includes a wall plate and a frame disposed on a mounting surface of the wall plate. The frame has an aligning hole and a locking hole. The interlocking device includes a housing unit, a rotation transferring unit, a transmitting unit and a locking member. The housing unit is securely disposed on one of the frames. The rotation transferring unit is disposed within the housing unit and has an input shaft which extends along and is rotatable about a first axis, and an output shaft which extends along a second axis that is perpendicular to the first axis. The output shaft is rotatable about the second axis with the rotation of the input shaft. The transmitting unit is coupled with and movable relative to the output shaft along the second axis, and is rotatable about the second axis with the rotation of the output shaft. The locking member is coupled with the transmitting unit and movable along and rotatable about the second axis with the movement and rotation of the transmitting unit. The locking member has a head portion which is coupled with the transmitting unit along the second axis, a positioning portion which extends from the head portion along the second axis and away from the transmitting unit, and a threaded portion which extends from the positioning portion along the second axis and away from the head portion. The locking member is insertable into the aligning hole of one of the frames to have the head portion abutting against the one frame, and the threaded portion is matingly engageable in the locking hole of the other one of the frames so as to lock the two modular building formworks.

With the input shaft extending along the first axis that is perpendicular to the second axis of the locking member, the two modular building formworks are aligned with and interlocked in a precise manner to form an even mold surface of a formwork assembly and the locking and unlocking operations are convenient to conduct.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
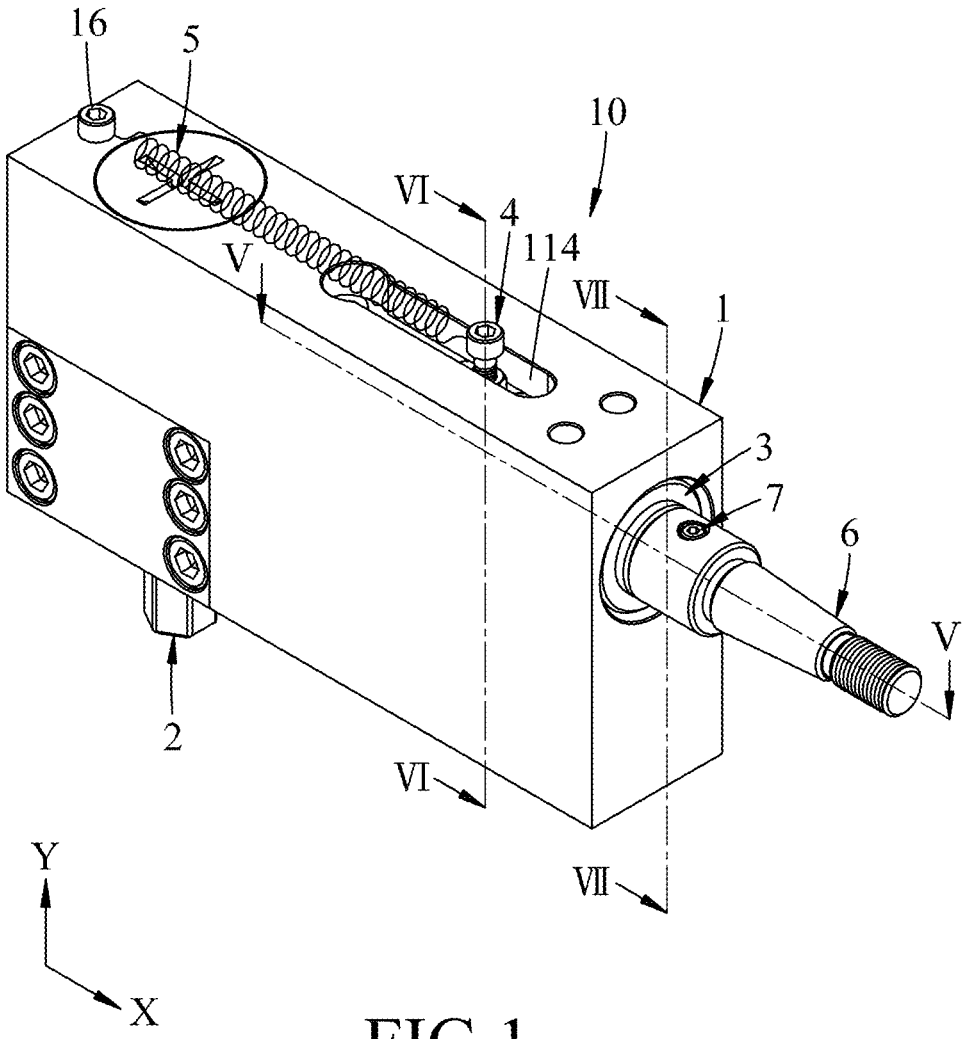
FIG. 1 is a perspective view illustrating an embodiment of an interlocking device according to the disclosure in a projecting position.

Referring to FIGS. 1 to 4, an embodiment of an interlocking device 10 for locking two modular building formworks 8 is shown in an upright disposition to cast a vertical wall for example. In the following description, a first axial direction (Y) and a second axial direction (X) are perpendicular to each other.

For example, the first axial direction (Y) is a vertical direction, and the second axial direction (X) is a horizontal direction. Each of the modular building formworks 8 includes a wall plate 81, a frame 82 disposed on a mounting surface of the wall plate 81, and two hoist rings 83 disposed on the wall plate 81. Each frame 82 has a plurality of aligning holes 821 and a plurality of locking holes 822. Each aligning hole 821 extends in the second axial direction (X), and has a larger-diameter section 823 and a first tapered hole section 824. Each locking hole 822 extends in the second axial direction (X), and has an internally threaded section 825 and a second tapered hole section 826.

Figure 2:
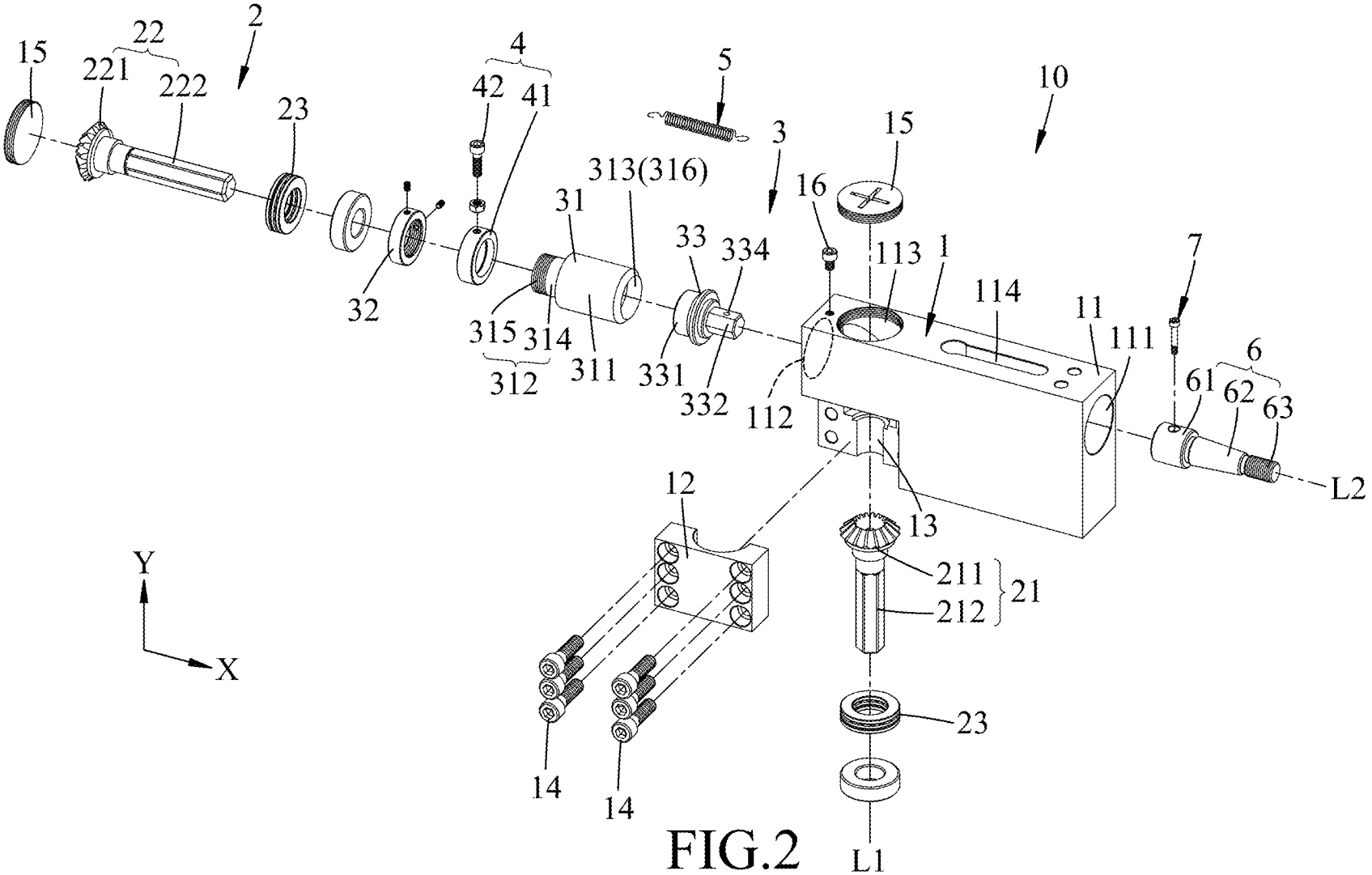
FIG. 2 is an exploded perspective view of the embodiment.

With reference to FIG. 2, the interlocking device 10 includes a housing unit 1, a rotation transferring unit 2, a transmitting unit 3, a guiding unit 4, a biasing member 5, a locking member 6 and a threaded shaft 7.

The housing unit 1 is securely disposed on the frame 82. The housing unit 1 has a housing body 11, a side cover 12 disposed on and cooperating with the housing body 11 to define an accommodation chamber 13, six screw bolts 14 securing the side cover 12 on the housing body 11, two seal covers 15 and a screw 16. The housing body 11 has an opening 111 and a first screw hole 112 formed at two opposite sides thereof in the second axial direction (X), and a second screw hole 113 and a guiding slot 114 formed in communication with the accommodation chamber 13 and respectively adjacent to the first screw hole 112 and the opening 111. The two seal covers 15 are respectively and threadedly engaged in the first screw hole 112 and the second screw hole 113. The guiding slot 114 extends in the second axial direction (X). The screw 16 is disposed on the housing body 11 adjacent to the second screw hole 113. The second screw hole 113 is formed between the screw 16 and the guiding slot 114.

A first axis (L1) is defined in the first axial direction (Y) and extends through the second screw hole 113, and a second axis (L2) is defined in the second axial direction (X) and intersects the first axis (L1) through the first screw hole 112 and the opening 111.

Figure 4:
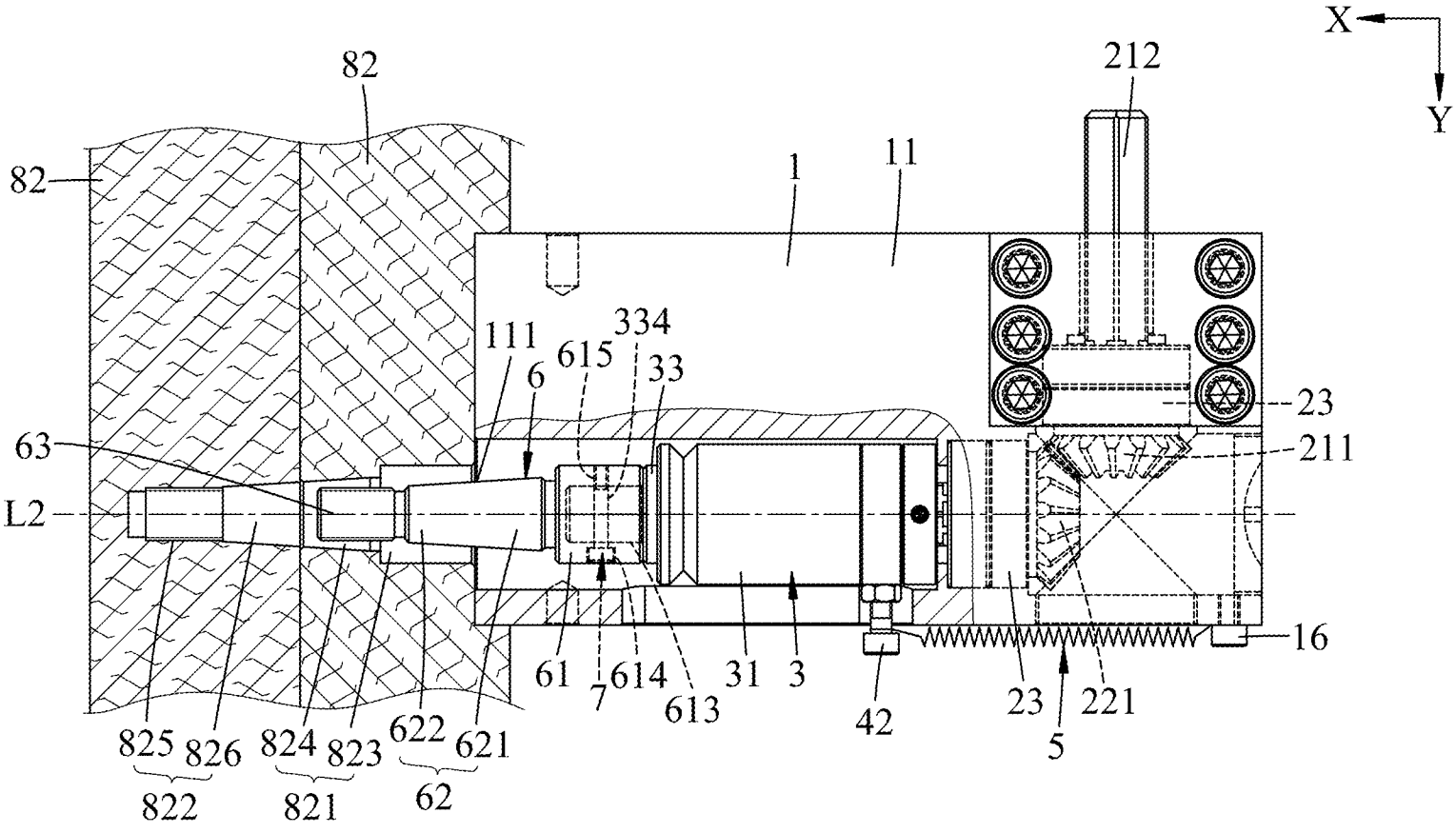
FIG. 4 is a fragmentary, partly-sectional view illustrating that the interlocking device interlocks two formworks and a locking member of the interlocking device is in a retracted position.

With reference to FIGS. 2 and 4, the rotation transferring unit 2 is disposed in the accommodation chamber 13 of the housing body 11, and has an input member 21, an output member 22 and two bearings 23. The input member 21 has an input bevel gear 211 which is rotatable about the first axis (L1) and adjacent to the first and second screw holes 112, 113, and an input shaft 212 which extends outwardly of the housing unit 1 along the first axis (L1) and is rotatable about the first axis (L1). The output member 22 has an output bevel gear 221 which meshes with the input bevel gear 211 to be rotatable about the second axis (L2), and an output shaft 222 which extends along the second axis (L2) toward the opening 111. Hence, the rotation of the input member 212 rotates the output shaft 222 about the second axis (L2). The bearings 23 are sleeved around the input shaft 212 and the output shaft 222, respectively.

Figure 5:
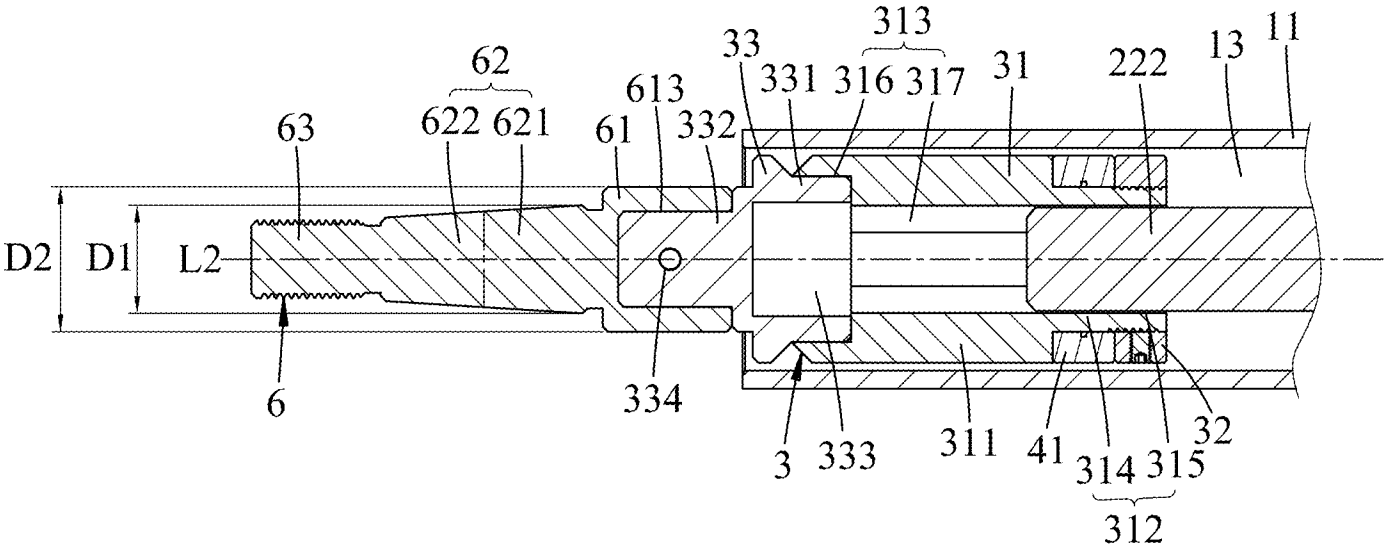
FIG. 5 is a fragmentary, sectional view taken from line V-V of FIG. 1.

With reference to FIGS. 2 and 5, the transmitting unit 3 is disposed in the accommodation chamber 13, and is coupled with and movable relative to the output shaft 222 along the second axis (L2). The transmitting unit 3 is rotatable about the second axis (L2) with the rotation of the output shaft 222. The transmitting unit 3 has a transmitting member 31, a threaded ring 32 and a coupler 33. The transmitting member 31 has a tubular sleeve 311 which is sleeved around the output shaft 222 to be movable relative to the output shaft 222 along the second axis (L2), and a tubular connecting portion 312 which extends from the tubular sleeve 311 along the second axis (L2). A penetrating hole 313 is formed through the tubular sleeve 311 and the tubular connecting portion 312 for the output shaft 222 to be movably disposed therein. The tubular connecting portion 312 has a non-threaded section 314 connected with the tubular sleeve 311, and an externally threaded section 315 for threadedly engaging the threaded ring 32. The penetrating hole 313 has a tubular portion 317 which has a cross-section that is perpendicular to the second axis (L2) and that mates with a cross-section of the output shaft 222 (see FIG. 5) such that the transmitting member 31 is movably and non-rotatably engaged with the output shaft 222, and an enlarged end portion 316 which is opposite to the tubular connecting portion 312 and which has a diameter larger than that of the tubular portion 317.

Figure 6:
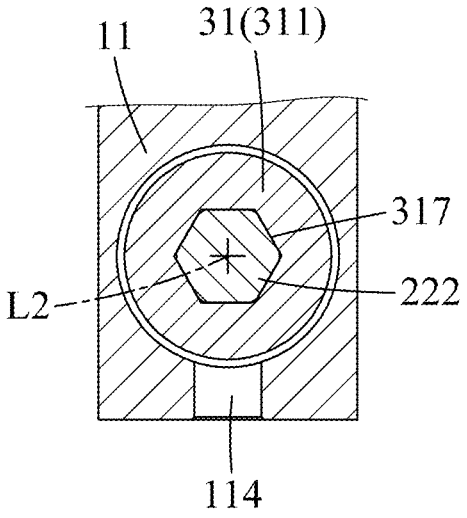
FIG. 6 is a fragmentary, sectional view taken from line VI-VI of FIG. 1.

With reference to FIG. 6, the cross-section of each of the tubular portion 317 and the output shaft 222 is of a non-circular shape such that the transmitting member 31 is rotated with the output shaft 222 about the second axis (L2). In this embodiment, the cross-section of the tubular portion 317 and the output shaft 222 is hexagonal.

With reference to FIGS. 2 and 5, the coupler 33 is connected with the transmitting member 31 to be rotatable with the transmitting member 31. The coupler 33 has an insert portion 331 which is inserted into the enlarged end portion 316 to be securely connected with the transmitting member 31, and a plug portion 332 which extends from the insert portion 331 along the second axis (L2) and away from the transmitting member 31. In one embodiment, the insert portion 331 is secured to the tubular sleeve 311 by soldering. The insert portion 331 has a recess 333 extending from an end opposite to the plug portion 332 and in communication with the tubular portion 317. The recess 333 has an inner diameter slightly larger than that of the tubular portion 317. The plug portion 332 has a transverse hole 334 extending radially therethrough.

The guiding unit 4 is disposed on the transmitting unit 3. The guiding unit 4 has a sleeve ring 41 which is sleeved on and in rotatable contact with the non-threaded section 314 of the transmitting member 31 and restrained by the threaded ring 32 to prevent movement of the guiding unit 4 along the second axis (L2), and an operating lever 42 which extends radially from the sleeve ring 41.

With reference to FIGS. 1 and 2, in this embodiment, the operating lever 42 is a screw threadedly engaged with the sleeve ring 41, and has an operating end that projects from the guiding slot 114 to be moved along the guiding slot 114. In this embodiment, the biasing member 5 is a tension spring having two ends which are respectively connected with the screw 16 and the operating end of the operating lever 42.

With reference to FIGS. 2 and 5, the locking member 6 is coupled with the transmitting unit 3, and is movable along and rotatable about the second axis (L2) with the movement and rotation of the transmitting unit 3. Specifically, the locking member 6 has a head portion 61 which is in the form of a socket 613 to be matingly engaged with the plug portion 332 along the second axis (L2) so as to permit the locking member 6 to be rotated with the coupler 33 about the second axis (L2), a positioning portion 62 which extends from the head portion 61 along the second axis (L2) and away from the transmitting unit 3, and a threaded portion 63 which extends from the positioning portion 62 along the second axis (L2) and away from the head portion 61. The positioning portion 62 is tapered gradually from the head portion 61 along the second axis (L2) and has a maximum outer diameter (D1) which is smaller than an outer diameter (D2) of the head portion 61.

Figure 7:
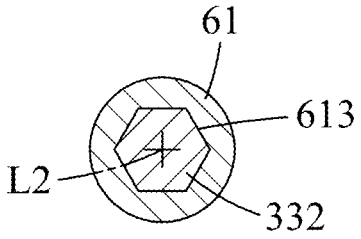
FIG. 7 is a sectional view taken from line VII-VII of FIG. 1.

With reference to FIG. 7, the cross-section of each of the socket 613 and the plug portion 332 is of a non-circular shape such that the locking member 6 is rotated with the coupler 33 about the second axis (L2).

In this embodiment, the cross-section of the socket portion 613 and the plug portion 332 is hexagonal.

With reference to FIGS. 2 and 4, the head portion 61 has a transverse hole 614 extending radially therethrough and in communication with the socket 613.

The threaded shaft 7 extends through the transverse holes 614, 334 and is threadedly engaged in a threaded hole 615 opposite to the transverse hole 614 so as to secure the head portion 61 to the plug portion 332 to prevent movement of the locking member 6 relative to the transmitting member 31 along the second axis (X).

With reference to FIGS. 2 and 5, the positioning portion 62 is tapered gradually from the head portion 61 along the second axis (L2), and has a first tapered section 621 which is connected with the head portion 61, and a second tapered section 622 which is connected between the first tapered section 621 and the threaded portion 63. In this embodiment, the first tapered section 621 is integrally formed with the second tapered section 622 in a single piece, and the taper rate of the first and second tapered sections 621, 622 is substantially the same and is about 1:8.

Figure 8:
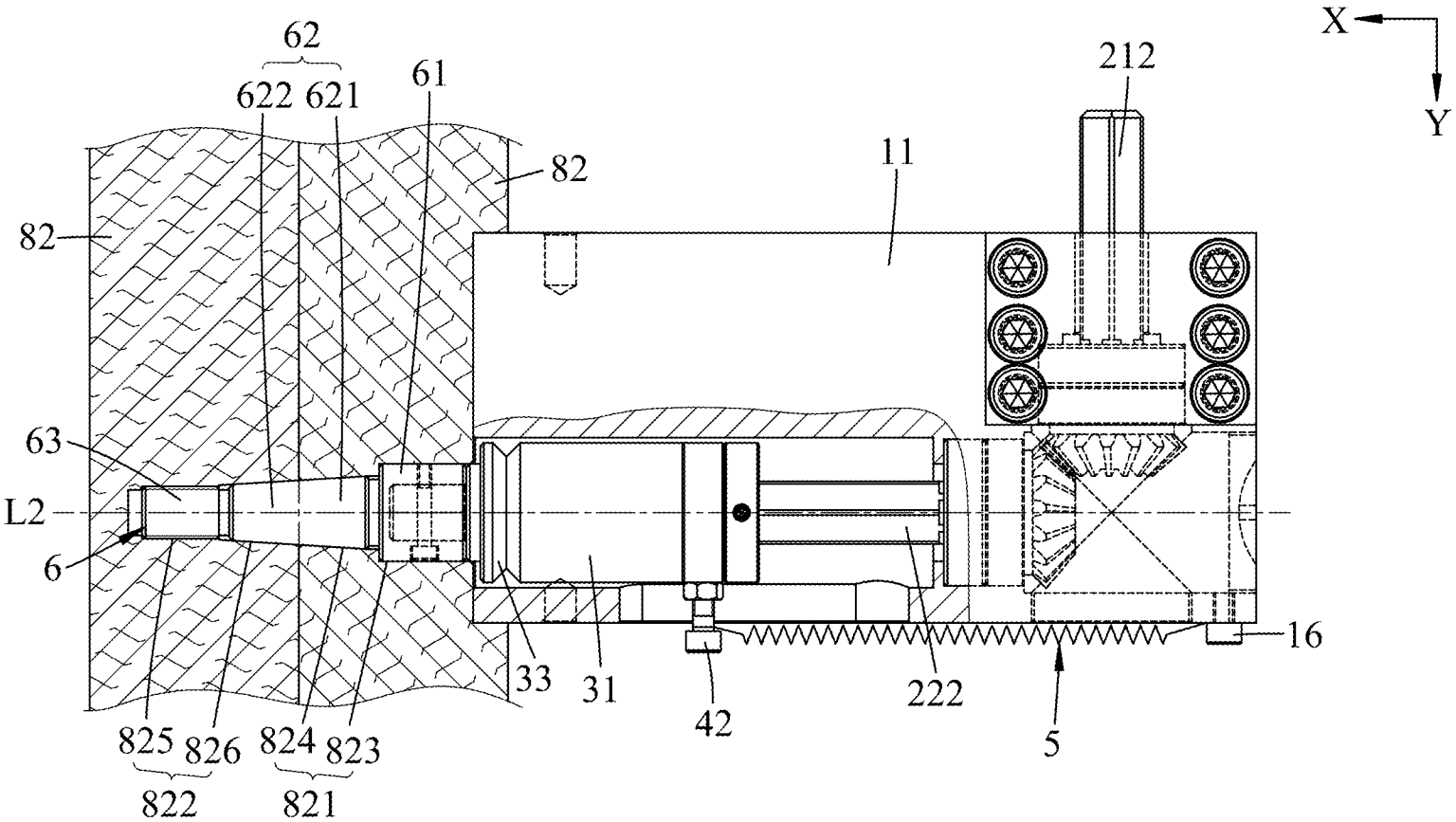
FIG. 8 is a view similar to FIG. 4, illustrating that the locking member is in the projecting position to lock the formworks.

With reference to FIGS. 4 and 8, the operating lever 42 is operable along the second axial direction (X) to move the transmitting unit 3 along the second axial direction (X) so as to shift the locking member 6 between a retracted position (see FIG. 4) and a projecting position (see FIG. 8). In the retracted position, the head portion 61 is retracted into the housing unit 1. The biasing member 5 is disposed to bias the transmitting unit 3 toward the output shaft 222 to urge the locking member 6 toward the retracted position. In the projecting position, the head portion 61 projects outwardly of the housing unit 1.

As an example, the installation procedure of the modular building formwork assembly will now be described.

Figure 3:
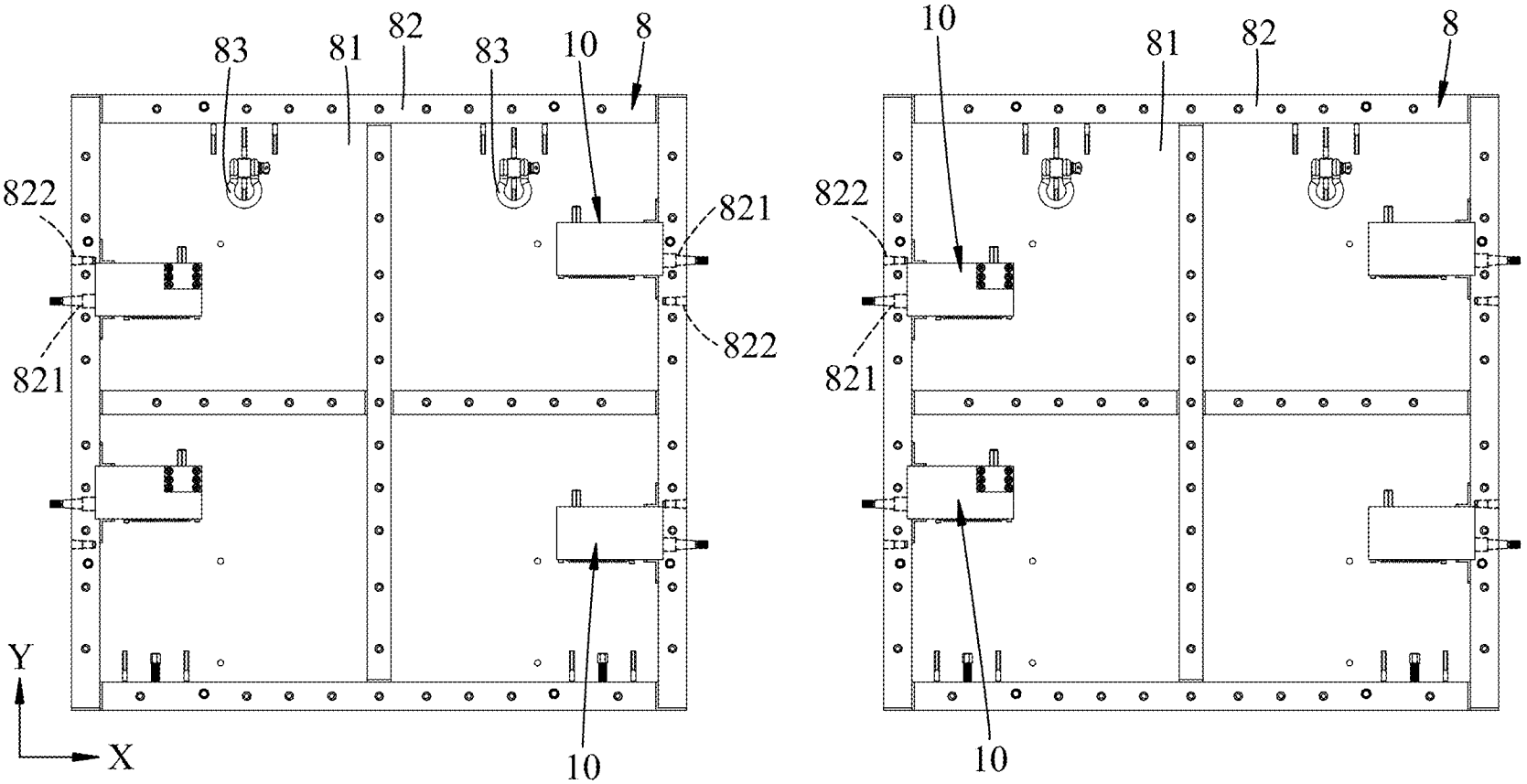
FIG. 3 is a schematic front view illustrating plural of the interlocking devices of the embodiment to lock two modular building formworks.

With reference to FIGS. 3, 4 and 8, two modular building formworks 8 are erected and aligned with each other to have the frames 82 abutting against each other. Four of the interlocking devices 10 of the embodiment are disposed on the frame 82 of each modular building formwork 8, and the housing unit 1 of each interlocking device 10 is securely mounted on the frame 82 to align the opening 111 with the corresponding aligning hole 821 and to keep the second axis (L2) in a left-to-right direction (i.e., in the horizontal direction).

In various embodiments, the frame 82 of each modular building formwork 8 may be formed with one aligning hole 821 and one locking hole 822 such that one interlocking device 10 is provided.

The locking member 6 is inserted into the aligning hole 821 of one frame 82 and is registered with the corresponding locking hole 822 of the other frame 82.

Subsequently, the operating lever 42 is pressed to move the transmitting member 31 and the locking member 6 along the second axial direction (X) to have the threaded portion 63 abutting against the juncture between the internally threaded section 825 and the second tapered hole section 826. Then, a hand tool is used to rotate the input shaft 212 to rotate the output shaft 222. The locking member 6 is hence rotated with the transmitting member 31. During rotation of the locking member 6, the tapered positioning portion 62 is matingly engageable with the first and second tapered hole sections 824, 826 to facilitate alignment and centering of the aligning hole 821 and the corresponding locking hole 822.

The threaded portion 63 is brought into engagement in the internally threaded section 825 of the locking hole 822. Meanwhile, the first tapered section 621 is engaged in the first tapered hole section 824, the second tapered section 622 is engaged in the second tapered hole section 826, and the head portion 61 is engaged in the larger-diameter section 823 and abuts against the shoulder between the first tapered hole section 824 and the larger-diameter section 823. The installation procedure of the two formworks 8 is accomplished. When the formworks 8 are to be removed from a hardened concrete structure, the locking member 6 is rotated to remove the threaded portion 63 from the internally threaded sections 825, and the locking member 6 is retracted in the housing unit 1 to the retracted position by means of the biasing member 5, which renders the disassembling of the formworks 8 convenient.

As illustrated, when the interlocking device 10 is used to lock two formworks 8 set up in the left-to-right direction, the locking member 6 is moved in the left-to-right direction to lock and unlock the frames 82. In this case, the input shaft 212 is disposed to project upwardly of the housing unit 1. Thus, it is convenient for an operator to use a hand tool to rotate the input shaft 212 so as to improve the workability and operating efficiency. Furthermore, the tapered positioning portion 62 of the locking member 6 is threadedly engageable with the aligning hole 821 and the locking hole 822 in a precise manner so as to render mold surfaces (opposite to the mounting surfaces of the wall plates 81) of the assembled formworks 8 even and to facilitate performing a further concrete pouring procedure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An interlocking device for locking two modular building formworks, each of the modular building formworks including a wall plate and a frame disposed on a mounting surface of the wall plate, the frame having an aligning hole and a locking hole, said interlocking device comprising:

a housing unit securely disposed on one of the frames;

a rotation transferring unit disposed within said housing unit and having an input shaft which extends along and is rotatable about a first axis, and an output shaft which extends along a second axis that is perpendicular to the first axis, said output shaft being rotatable about the second axis with the rotation of said input shaft;

a transmitting unit coupled with and movable relative to said output shaft along the second axis and being rotatable about the second axis with the rotation of said output shaft;

a locking member coupled with said transmitting unit and movable along and rotatable about the second axis with the movement and rotation of said transmitting unit, said locking member having a head portion which is coupled with said transmitting unit along the second axis, a positioning portion which extends from said head portion along the second axis and away from said transmitting unit, and a threaded portion which extends from said positioning portion along the second axis and away from said head portion, wherein said locking member is insertable into the aligning hole of one of the frames to have said head portion abutting against the one frame, and said threaded portion is matingly engageable in the locking hole of the other one of the frames so as to lock the two modular building formworks, wherein said housing unit defines therein an accommodation chamber for receiving said rotation transferring unit and said transmitting unit, and a guiding slot which extends in a horizontal direction parallel to the second axis and which is in communication with said accommodation chamber; and a guiding unit which is disposed on said transmitting unit, said guiding unit having a sleeve ring which is sleeved on and in rotatable contact with said transmitting unit, and an operating lever which extends radially from said sleeve ring and has an operating end that projects from said guiding slot to be moved along said guiding slot.

2. The interlocking device as claimed in claim 1, wherein said head portion of said locking member is moved with said transmitting unit between a retracted position, where said head portion is retracted into said housing unit, and a projecting position, where said head portion projects outwardly of said housing unit.

3. The interlocking device as claimed in claim 2, further comprising a biasing member interposed between said transmitting unit and said housing unit to bias said transmitting unit toward said output shaft to urge said locking member toward the retracted position.

4. An interlocking device for locking two modular building formworks, each of the modular building formworks including a wall plate and a frame disposed on a mounting surface of the wall plate, the frame having an aligning hole and a locking hole, said interlocking device comprising:

a housing unit securely disposed on one of the frames;

a rotation transferring unit disposed within said housing unit and having an input shaft which extends along and is rotatable about a first axis, and an output shaft which extends along a second axis that is perpendicular to the first axis, said output shaft being rotatable about the second axis with the rotation of said input shaft;

a transmitting unit coupled with and movable relative to said output shaft along the second axis and being rotatable about the second axis with the rotation of said output shaft; and a locking member coupled with said transmitting unit and movable along and rotatable about the second axis with the movement and rotation of said transmitting unit, said locking member having a head portion which is coupled with said transmitting unit along the second axis, a positioning portion which extends from said head portion along the second axis and away from said transmitting unit, and a threaded portion which extends from said positioning portion along the second axis and away from said head portion, wherein said locking member is insertable into the aligning hole of one of the frames to have said head portion abutting against the one frame, and said threaded portion is matingly engageable in the locking hole of the other one of the frames so as to lock the two modular building formworks, wherein said transmitting unit has a transmitting member which is sleeved around said output shaft to be movable relative to said output shaft along the second axis, and a coupler which is connected with both said transmitting member and said head portion of said locking member to be rotatable with said transmitting member, said transmitting member having a tubular portion which has a cross-section that is perpendicular to the second axis and that mates with a cross-section of said output shaft such that said transmitting member is movably and non-rotatably engaged with said output shaft.

5. The interlocking device as claimed in claim 4, wherein said cross-section of each of said tubular portion and said output shaft is of a non-circular shape such that said transmitting member is rotated with said output shaft about the second axis.

6. The interlocking device as claimed in claim 4, wherein said head portion of said locking member is in form of a socket, said coupler having a plug portion which extends along the second axis and which is matingly engaged in said socket to permit said locking member to be rotated with said coupler about the second axis.

7. An interlocking device for locking two modular building formworks, each of the modular building formworks including a wall plate and a frame disposed on a mounting surface of the wall plate, the frame having an aligning hole and a locking hole, said interlocking device comprising:

a housing unit securely disposed on one of the frames;

a rotation transferring unit disposed within said housing unit and having an input shaft which extends along and is rotatable about a first axis, and an output shaft which extends along a second axis that is perpendicular to the first axis, said output shaft being rotatable about the second axis with the rotation of said input shaft;

a transmitting unit coupled with and movable relative to said output shaft along the second axis and being rotatable about the second axis with the rotation of said output shaft; and a locking member coupled with said transmitting unit and movable along and rotatable about the second axis with the movement and rotation of said transmitting unit, said locking member having a head portion which is coupled with said transmitting unit along the second axis, a positioning portion which extends from said head portion along the second axis and away from said transmitting unit, and a threaded portion which extends from said positioning portion along the second axis and away from said head portion, wherein said locking member is insertable into the aligning hole of one of the frames to have said head portion abutting against the one frame, and said threaded portion is matingly engageable in the locking hole of the other one of the frames so as to lock the two modular building formworks, wherein said positioning portion of said locking member is tapered gradually from said head portion along the second axis and has a maximum outer diameter which is smaller than an outer diameter of said head portion, said positioning portion having a first tapered section which is connected with said head portion, and a second tapered section which is connected between said first tapered section and said threaded portion, wherein said first tapered section is engaged in the aligning hole of one of the frames and said second tapered section is engaged in the locking hole of the other one of the frames when said locking member is inserted into the aligning hole of the one frame and said threaded portion is threadedly engaged in the locking hole of the other frame.

8. The interlocking device as claimed in claim 7, wherein said first tapered section is integrally formed with said second tapered section in a single piece.

9. The interlocking device as claimed in claim 7, wherein a taper rate of said first and second tapered sections is 1:8.

* * * * *